US007969370B1

(12) United States Patent
Dinh et al.

(10) Patent No.: US 7,969,370 B1
(45) Date of Patent: Jun. 28, 2011

(54) LIQUID ANTENNAS

(75) Inventors: Vincent V. Dinh, San Diego, CA (US); Eric W. Hendricks, San Diego, CA (US)

(73) Assignee: The United States of America as repesented by the Secretary of the Navy, Washington, DC (US)

( * ) Notice: Subject to any disclaimer, the term of this patent is extended or adjusted under 35 U.S.C. 154(b) by 381 days.

(21) Appl. No.: 12/390,868

(22) Filed: Feb. 23, 2009

(51) Int. Cl.
*H01Q 1/00* (2006.01)

(52) U.S. Cl. ..... 343/720; 343/732; 343/788; 343/866; 343/880; 343/915

(58) Field of Classification Search ..... 343/720, 343/788, 872, 732, 743, 880, 915, 866
See application file for complete search history.

(56) References Cited

U.S. PATENT DOCUMENTS

| | | | | |
|---|---|---|---|---|
| 4,498,086 | A | 2/1985 | Sandler | |
| 6,674,970 | B1 | 1/2004 | Anderson | |
| 6,859,189 | B1 * | 2/2005 | Ramirez et al. | 343/815 |
| 7,262,734 | B2 | 8/2007 | Wood | |

OTHER PUBLICATIONS

Unpublished U.S. Appl. No. 12/119,302, titled, "Electrolytic Fluid Antenna" by Daniel Tam, filed May 12, 2008.
Fayad, H.; Record, P.; Broadband Liquid Antenna, Electronics Letters, vol. 42, Issue 3, Feb. 2, 2006 pp. 133-134.
David H. Hatch; The "ILA"—Ionic Liquid Antenna Concept by N9ZRT; Nov. 27, 2002, available on the internet at http://www.wireservices.com/n9zt/ila/ila.html.

* cited by examiner

*Primary Examiner* — Jacob Y Choi
*Assistant Examiner* — Shawn Buchanan
(74) *Attorney, Agent, or Firm* — Kyle Eppele; J. Eric Anderson

(57) ABSTRACT

A fluidic antenna is described, using an electromagnetic energy coupler, a non-metallic container coupled to the electromagnetic energy coupler, a fluid having charged particles moving through the non-metallic container at a predetermined rate, and a charge focuser disposed about the non-metallic container, wherein the electromagnetic energy coupler is configured to couple energy between the fluid and at least one of a transmitter and receiver, and the charge focuser is configured to adjust a cross sectional area of charged particles in the fluid to result in a fluid characteristic impedance that approaches that of a surrounding medium, thereby enabling at least one of launching and receiving electromagnetic energy.

20 Claims, 4 Drawing Sheets

LIQUID ANTENNAS

FEDERALLY-SPONSORED RESEARCH AND DEVELOPMENT

This invention (Navy Case No. 099277) was developed with funds from the United States Department of the Navy. Licensing inquiries may be directed to the Office of Research and Technical Applications, Space and Naval Warfare Systems Center, San Diego, Code 2112, San Diego, Calif., 92152; voice 619-553-2778; email T2@spawar.navy.mil.

FIELD OF THE INVENTION

This disclosure relates to communication systems. More particularly, this disclosure relates to an antenna system utilizing a charge carrying fluid as the radiating medium.

BACKGOUND OF THE INVENTION

In a shipboard environment, real estate is a precious commodity, especially at the top-side of the ship. A mid-sized ship will have somewhere in the range of 50 or more antennas to provide the necessary communication and tactical capabilities. Thus, there has been an on-going tradeoff between the available real estate on the ship versus the number of antennas desired for deployment on the ship. Another issue is that all of the antennas have fixed metal as the primary radiating surface and, therefore, even in the non-active mode, the surface of the antenna will reflect energy. The reflected energy (sourced from another vessel) renders the ship "visible" to the other vessel's radar.

Therefore, there is a need for an antenna system that can provide a low or non-existent signature when in a non-operational mode. Commensurate with this need, is the desire for an antenna system that is flexible enough to be significantly reduced in size when un-deployed, versus deployed.

SUMMARY

The foregoing needs are met, to a great extent, by the present disclosure, wherein systems and methods are provided that in some embodiments facilitate an antenna system utilizing a charge carrying fluid as a radiating element.

In accordance with one aspect of the present disclosure, a fluidic antenna is provided, comprising: an electromagnetic energy coupler; a non-metallic container coupled to the electromagnetic energy coupler; fluid having charged particles moving through the non-metallic container at a predetermined rate; and a charge focuser disposed about the non-metallic container, wherein the electromagnetic energy coupler is capable of coupling energy between the fluid and at least one of a transmitter and receiver, and the charge focuser is capable of adjusting a cross sectional area of charged particles in the fluid to result in a fluid characteristic impedance that approaches that of a surrounding medium, thereby enabling at least one of launching and receiving electromagnetic energy.

In accordance with another aspect of the present disclosure, a fluidic antenna is provided, comprising: means for coupling energy; means for holding charged particles in suspension, wherein the means for holding is moving at a predetermined rate of velocity; means for conveying the means for holding; and means for focusing charges in the means for holding, wherein the means for coupling energy is capable of coupling energy between the means for holding and at least one of a transmitter and receiver, and the means for focusing is capable of adjusting a cross sectional area of charged particles in the means for holding to result in a characteristic impedance of the means for holding that approaches that of a surrounding medium, thereby enabling at least one of launching and receiving electromagnetic energy.

In accordance with yet another aspect of the present disclosure, a method for radiating or receiving electromagnetic energy using a liquid medium containing charged particles is provided, comprising: moving the liquid medium through a non-metallic container at a predetermined rate; coupling an electrical signal into or from the charged particles resident in the moving liquid medium; varying a cross section of the charged particles in the liquid medium; and adjusting at least one of a rate of velocity of the liquid medium and the cross section of the charged particles to result in a characteristic impedance of the liquid medium to approach that of a surrounding medium's characteristic, thereby enabling at least one of launching and receiving electromagnetic energy.

DETAILED DESCRIPTION

Figure 1:
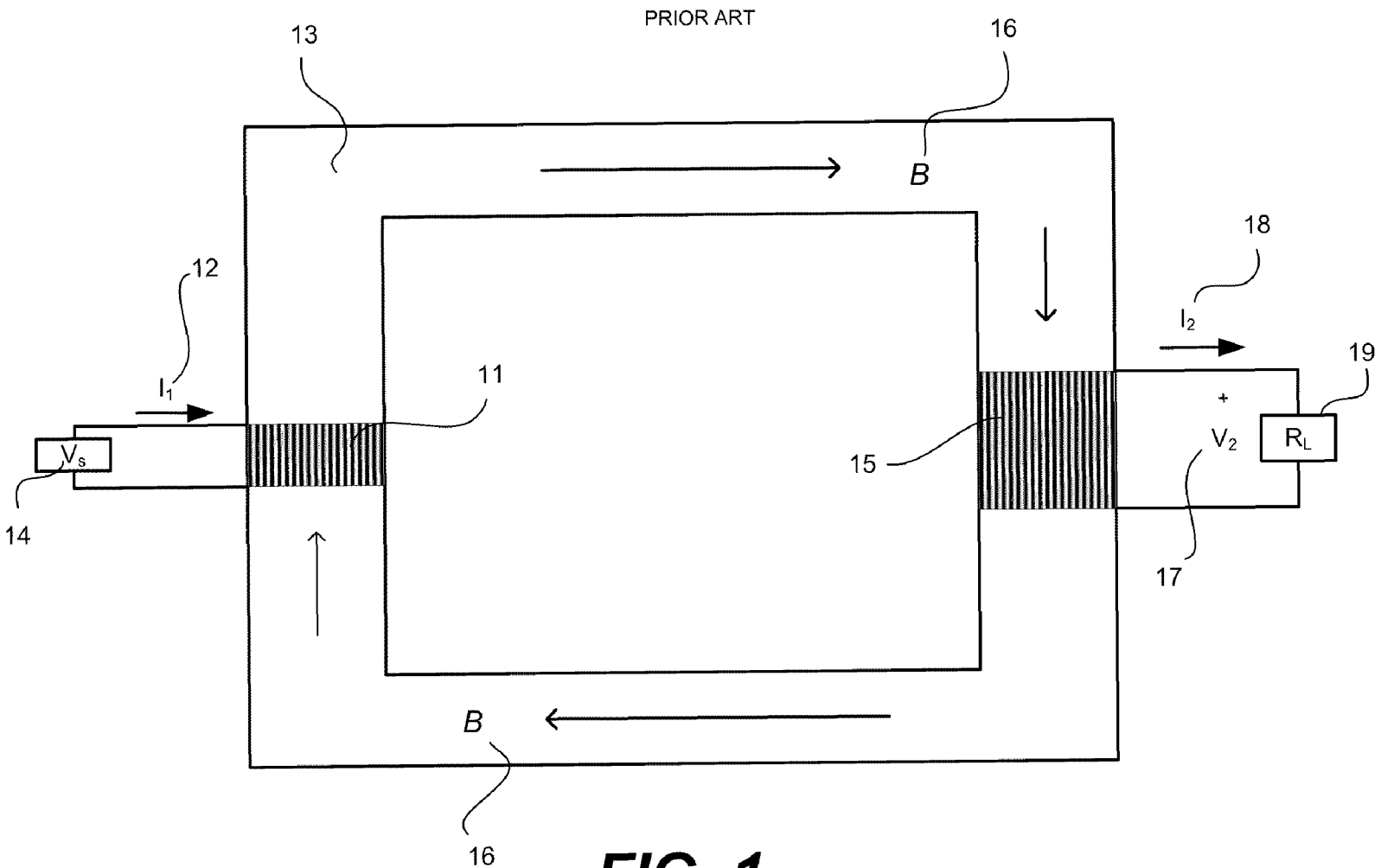
FIG. 1 is an illustration of a typical transformer.

An antenna system and method of radiating electromagnetic energy is elucidated. A fluid that carries charged particles in the form of ions is used as the radiating medium. As a fluid, the medium can be pumped into non-metallic tubes and thereby "deployed' when the antenna is activated. When deactivated, the fluid can be pumped out, deflating the antenna structure resulting in both a significant reduction in size as well as producing little to practically no electromagnetic footprint. Using sea water as the charge carrying fluid, the exemplary embodiments are well suited for ocean going vessels. A mechanism for injecting RF energy into the fluid is explored as well as how to release the injected energy in the fluid into free space as a wave.

Propagation of traditional non-ionizing radiation is premised on matching the antenna's impedance to that of free space to allow the energy coupled to the antenna to "leak" into space as a traveling wave. Resonance in combination with sizing the antenna elements as a function of the frequency is the well proven mechanism for facilitating this effect. As will be evident in the following exemplary embodiments, by adjusting the cross sectional area of a charged fluid antenna, the desired free space matching impedance can be obtained for radiation of electromagnetic energy.

For a fluid to radiate radio frequency (RF) energy, the fluid's electrical characteristic impedance should be comparable to that of air (presuming air is the medium to be transmitted into). The actual value of the characteristic impedance will determine how much is coupled into the air. The characteristic impedance of any material is a function of the material's inductive and capacitive density. For a fluid, the capacitive density is a function of the position of the constituent flow elements and if this is a fixed value, then the capacitive density will be fixed. Inductive density is a function of the electrical cross-sectional area of the flow. So, if the capacitive density is fixed, then by affecting the cross section, the overall characteristic impedance can be adjusted to match that of air, thus enabling RF radiation to occur.

Maxwell's equations govern the relationship between the electric field component(s) and the magnetic field component (s) in terms of the characteristic impedance of the medium that the wave is traveling in. For air, the relationship for a transverse traveling wave is:

$$\eta_{air}\vec{H}\times\hat{k}=\vec{E} \quad \text{(Eq. 1)}$$

The same relationship holds true for a fluid, where the characteristic impedance of air ($\eta_{air}$) is replaced with the characteristic impedance of the fluid ($\eta_{fluid}$). For a wave to transition from the fluid to the air, the material's characteristic impedance $\eta$ should be nearly equivalent at the liquid/air boundary. This understanding is similar to that of matched loads in transmission line theory or maximum power transference in lumped circuit theory, using voltage (V) and current (I) as the one-dimensional representation of the corresponding electrical and magnetic fields, respectively.

The fluid's characteristic impedance $\eta_{fluid}$ can be derived from the standard transmission line equation containing the "forward" and "reverse" traveling wave relationship:

$$V=V_o e^{j(\omega t-kx)}\pm V_o e^{j(\omega t+kx)} \quad \text{(Eq. 2)}$$

$$I=\frac{V_o e^{j(\omega t-kx)}}{\eta_{fluid}}-\frac{V_o e^{j(\omega t+kx)}}{\eta_{fluid}} \quad \text{(Eq. 2')}$$

where $$\eta_{fluid}=\sqrt{\frac{r+j\omega l}{j\omega c}} \quad \text{(Eq. 3)}$$

r=fluid resistance density,
l=fluid inductance density,
c=fluid capacitive density,
ω=operation frequency (2πf).

If the derivative of these expressions is taken, then the 1-D electric and magnetic fields along the transmission "line" becomes:

$$E_x=dV/dx=(-jk)V_o e^{j(\omega t-kx)}+(jk)V_o e^{j(\omega t+kx)}$$

$$H_x=dI/dx=(-jk)\frac{V_o}{\eta_{fluid}}e^{j(\omega t-kx)}-(jk)\frac{V_o}{\eta_{fluid}}e^{j(\omega t+kx)} \quad \text{(Eq. 4)}$$

If the reverse wave condition is disallowed (presuming no reflection), then the resulting expression of Eq. 4 can be simplified to $\eta_{fluid}\cdot H_x=E_x$. As is apparent, this is similar to Eq. 1. By applying continuity conditions at any of the fluid/air boundaries, the reflection coefficient (Γ) becomes:

$$\Gamma=\frac{\eta_{fluid}-\eta_{air}}{\eta_{fluid}+\eta_{air}} \quad \text{(Eq. 5)}$$

If $\eta_{fluid}=\eta_{air}$, then Γ=1, and there will be complete transmission, i.e., launching of the energy wave from the fluid into the air. Here, it can be seen that there are two (2) conditions for radiation. One, the fluid's characteristic impedance $\eta_{fluid}$ should be matched to the characteristic impedance of the surrounding air $\eta_{air}$. Two, a "forward" traveling wave, or one-way mode is required. The first condition can be achieved by pumping the charge carrying fluid (in this instance, sea water is utilized as the suitable fluid) through a tube or channel and by some form of cross sectional manipulation, arrive at the desired flow cross section that gives us the equivalent or near $\eta_{air}$ value for the fluid. One possible cross sectional manipulation method can be through the use of a magnetic field for constriction (discussed in detail below) of the constituent charges in the fluid.

To achieve the second condition, the fluid can be a uniform or laminar flow away from the source. Thus, material continuity in the tube or channel can be assured, and with no internal reflection occurring, there will be no excitation of a "back" wave. The equations for obtaining these conditions are now detailed.

The fluid characteristic impedance $\eta_{fluid}$ is understood to be a function of the densities discussed above and shown in Eq. (3), restated here again for convenience:

$$\eta_{fluid}=\sqrt{\frac{r+j\omega l}{j\omega c}} \quad \text{Eq. (3)}$$

It is understood that since the capacitive density (c) of the fluid is a function of displacement, if the fluid antenna is fixed with respect to a surface (as a non-limiting example, the deck of a ship), then c will be a constant value $c_0$. If the fluid is sea water at nominal temperature and at sea level pressure, then it's resistivity r will be:

$$r\cdot\rho_{sea}\sim 0.2\Omega/\text{m} \quad \text{Eq. (6)}$$

At any given frequency, this value will be small compared to the larger fluid inductive density, so $\eta_{fluid}$ can be approximated as:

$$\eta_{fluid}\sim\sqrt{\frac{l}{c_o}} \quad \text{Eq. (7)}$$

What is evident in Eq. (7) is that given the above approximations, the characteristic impedance of sea water is solely controlled by the fluid inductive density. In general, fluid inductive density can be found to be a function of the electrical length L and the ionic cross section σ, expressed below as:

$$l\sim L^2\mu/\sigma \quad \text{Eq. (8)}$$

where
L=electrical path length,
μ=fluid permeability,
σ=ionic cross section of flow.

Since the electrical length L and the fluid permeability μ are constants, the only variable that can dynamically affect the fluid impedance is the ionic cross section σ.

Manipulating the ionic cross section σ can be achieved by first understanding that electrical conduction in fluids is due to ionic motion. If a DC bias current is applied to the ions of the fluid, the bias current would generate a DC magnetic induction field (Bio-Savart's law of induction) which would "herd" the ions together. For the fluid antenna, the induced magnetic field is controlled by the applied DC bias applied to the fluid. Thus, the magnetic field is expressible as B~Il, where I=DC bias current and l=fluid's inductance density. Note that the B field is defined by the fluid's inductive density l, which is in turn affected by the ionic cross section, which is in turn affected by the field B. The connection between the cross section and the B field is such that the B field interacts with the ionic motion in the fluid to generate a confining force F on the ions:

$$\vec{F} = \vec{v} \times \vec{B} \quad \text{Eq. (9)}$$

where $\vec{v}$ =velocity of ions, $\vec{B}$=magnetic-induction field.

Since the ionic velocity can be controlled by pumps and the magnetic induction field B by the DC bias current, the confining force F becomes controllable. Fick's law of diffusion supplies the dispersal force on ions in the fluid, but the confining force F provides an opposing force on the ions, thus focusing the ions in the fluid. Thus, the cross section of the ions in the fluid can be made a function of the flow rate and the DC bias field (e.g., charge focuser), which means that by proper adjustment of these two variables, the cross section of the influenced ions can be dynamically sized.

Accordingly, affecting the fluid impedance becomes the "simple" matter of adjusting the flow rate and the applied DC bias field. Now that an approach for impedance matching the fluid to air has been determined, the issue of impressing a "signal" onto the traveling wave is discussed.

RF signal injection into an "electrical" object can be achieved by inducing an electric field using magnetic induction. Though other methods are available, it will suffice for purposes of explanation to use magnetic induction as an example. Magnetic induction is best illustrated by the transformer example of FIG. 1. Here, the primary coil 11 is wound around a core 13 having a secondary coil 15 wound thereto. Time varying current 12, arising from varying voltage source 14, travels in the primary coil 11 to induce a magnetic field B 16 normal to the plane of the primary coil winding 11. The core 13, being of a high permeability material ($\mu >> 1$) concentrates the B field 16 and "channels" it to intersect the secondary coil 15. The result is that a time varying voltage 17 is induced in the secondary coil 15 by the time varying B field 16. The resulting voltage 17 generates a current 18 across load 19.

To provide information communication capabilities, the transformer model of FIG. 1 may be modified to have a carrier frequency in addition to the "signal" portion of the RF injection. RF communication methodologies using carrier frequencies are well known in the art. Similarly, the operation of a transformer and variations thereof are well known and, therefore, additional details to these topics are understood to be within the purview of one of ordinary skill in the art.

It is expressly understood that the above example is only one of several possible ways for RF injection, this being perhaps the simplest way using magnetic flux linkage. Accordingly, the use of this one example should not be construed as a limiting example, as numerous other methods, schemes, approaches whether electromagnetic or otherwise, that provide similar or more effective objectives in terms of excitation and/or detection are known in the art. Therefore, other methods, schemes, approaches and so forth, for exciting/detecting a voltage or current in an object are understood to be fully within the spirit and scope of this disclosure. Using the above enabling example, an RF injection scheme can be developed for injecting RF energy into a loop containing fluid charges.

A verification of the principles described above has been performed as hereby outlined. Returning to first principles, it is understood that RF "spillage" into the air is tantamount to radiation of RF energy. To see if RF spillage is even possible under the conditions described, an examination of the fluid's characteristic impedance $z_f$ is necessary (it is noted that characteristic impedance in lumped or distributed circuits is signified by the symbol z, while in field theory it is signified by the symbol $\eta$). The characteristic impedance $z_f$ is not an actual physical value, but a characterization of the object under examination in terms of its electrical parameters. This impedance can be approximated by taking the simple geometry case of a uniform tube of fluid, where the characteristic impedance $z_f$ can be estimated from the "measured" impedance $z_m$ found by placing two electrical probes at opposite ends of the uniform tube. Symmetry dictates that:

$$z_m \sim \frac{1}{2} L z_f \quad \text{Eq. (10)}$$

where $z_m$=measured impedance between probe points,

L=mean tube circumference.

If the fluid is far away from any metallic structure, its line capacitance $c_f$ is approximately equivalent to its permittivity $\epsilon_f$. This condition can be achieved by judicious tube placement and through the use of low permittivity tube material The approximate fluid characteristic impedance can be simplified to:

$$\eta_{fluid} \sim \sqrt{\frac{l}{\varepsilon_o}} \quad \text{Eq. (11)}$$

where $\epsilon_f$=fluid permittivity. Based on Eq. (11), the bulk of these parameters are either fixed or known, with the remaining parameters being easily controllable. By adjusting the above parameters, the characteristic impedance $z_f$ of the fluid can be adjusted.

Next, the issue of coupling RF energy from a source into the fluids deserves investigation. The basic question here is "How much energy from the source is actually 'linked' into the fluid?" To address this question, a calculation of injection efficiency is performed. Generalizing from FIG. 1's transformer diagram, using a single turn secondary coil having the fluid, the ratio of the secondary voltage (denoted here as $V_m$) is related to the voltage of the primary voltage (denoted here as $V_s$) by the ratio of turns on the primary coil according to: $V_s \sim nV_m$. Therefore, the variable n represents the number of turns in the primary coil and expresses a very simple and powerful relationship for increasing or decreasing the secondary voltage.

Next, the power dissipated in the fluid becomes:

$$P_f = \frac{|V_s|^2}{n^2} \mathrm{Re}\left\{\frac{1}{z_m}\right\} \quad \text{Eq. (12)}$$

And the power dissipated at the input coil becomes:

$$P_s = \frac{|V_s|^2}{n} \mathrm{Re}\left\{\frac{1}{z_{tran}}\right\} \quad \text{Eq. (13)}$$

The injection efficiency is simply the ratio of the two powers:

$$\eta_{inj} = P_f / P_s \sim \frac{1}{n\mathrm{Re}\{z_m\}\mathrm{Re}\left\{\frac{1}{z_{tran}}\right\}} \quad \text{Eq. (14)}$$

where n=the number of loops on the input coil, $z_m$=measured fluid impedance between the probe points, $z_{tran}$=measured trans-impedance between the input coil and the point points.

To estimate the actual injection efficiency, the fluid's measured impedance $z_m$ and the trans-impedance $z_{tran}$ are needed. The fluid's measured impedance $z_m$ can be found from the discussion above, and the trans-impedance $z_{tran}$ can be obtained as follows: Let the RF source be a sinusoidal current source $i_s$. To obtain the frequency response, measure both the RF source current $i_s$ value and the corresponding electromotive force (EMF) $v_m$ value. Noting both the magnitude and the phase, the trans-impedance is simply the complex ratio of the voltage to the current: $z_{tran}=v_m/i_s$. Assuming negligible losses in the fluid, this relationship suggests that for a uniform tube, the efficiency of the linkage will not vary upon location. With these two conditions confirmed, a fluid antenna can now be devised.

Figure 2:
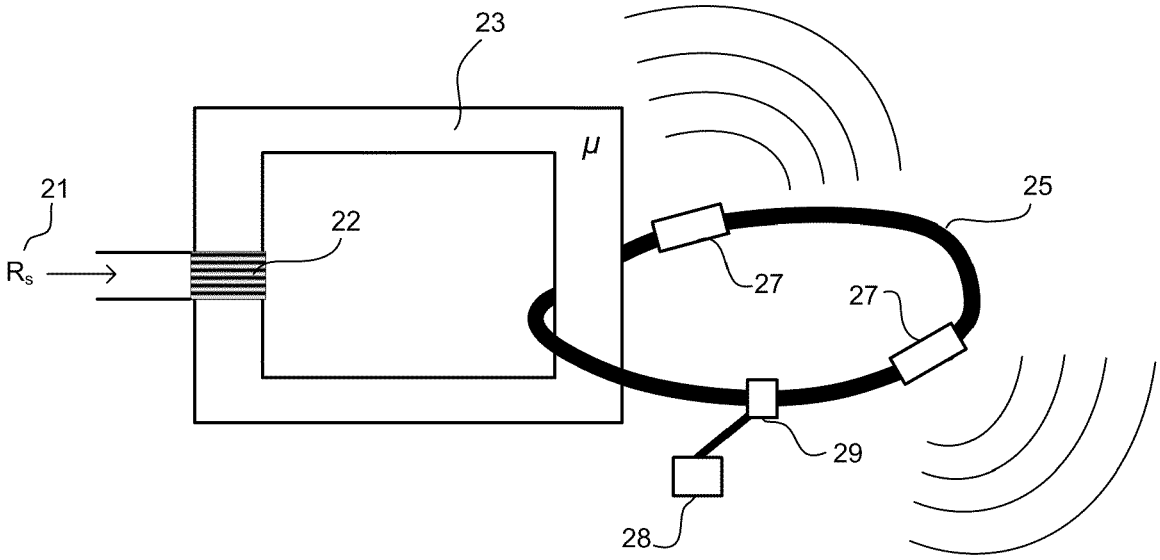
FIG. 2 provides an illustration of one exemplary fluid antenna embodiment.

FIG. 2 provides an illustration of one exemplary fluid antenna embodiment. The exemplary fluid antenna utilizes the RF excitation approach described above in FIG. 1, using RF source 21, primary coil 22 and μ metal 23. The secondary coil system of FIG. 1 is represented by tube 25 carrying the charge carrying fluid (inside tube 25). Here, one or more charge focusers 27 are illustrated as being disposed about various points along the tube 25. The charge focusers 27 can provide the DC bias field discussed above for affecting the cross section of charges in fluid. Pumping system 28 is coupled to the tube 25 via a valve or coupler 29, which pumps the fluid at a specified rate to provide the flow rate control for also affecting the cross section of the charges in the fluid. The pumps 28 may, in some instances, provide different flow rates for reasons described above. With RF energy being induced into the moving fluid and the cross section being secondarily controlled by the charge focusers 27, energy from the RF source 21 can be effectively transmitted into space. Thus, the embodiment of FIG. 2 provides a simplified scheme for a charge carrying fluid antenna system.

It should be noted that while the charge focusers 27 are described in the context of utilizing a DC bias field as the mechanism for constricting the ions to adjust the cross section (and thereby the characteristic impedance of the fluid), other methods and systems that are known in the art may be used. In some instances, an acoustic or even an electric field produced about the tube 25 may be used to constrict or adjust the cross section of the moving ions. As is well known to one of ordinary skill in the art, there are numerous methods for affecting the motion and direction of moving charges, the DC bias approach described above being only one available method. Accordingly, variations of and modifications to how the charged particles or ions are manipulated are understood to be within the spirit and scope of this disclosure.

Also, while the exemplary embodiments described herein are illustrated using a "square" or rectangular RF injection mechanism (μ metal ring), it is understood that the shape is arbitrary, as other shapes, contours, and arrangements for the RF injection mechanism can be used. Thus, circular, oblong, and so forth shapes may be used. Also, while "indirect" coupling may be used, a direct injection approach can be utilized, according to design preference.

Figure 3A:
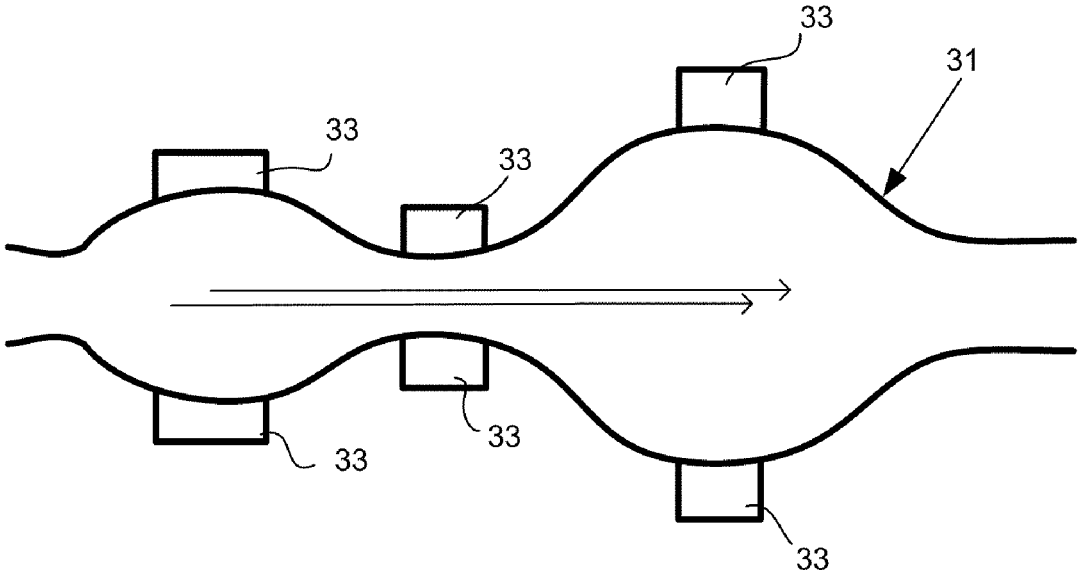
FIGS. 3A-B are illustrations of other approaches to varying cross section.
Figure 3B:
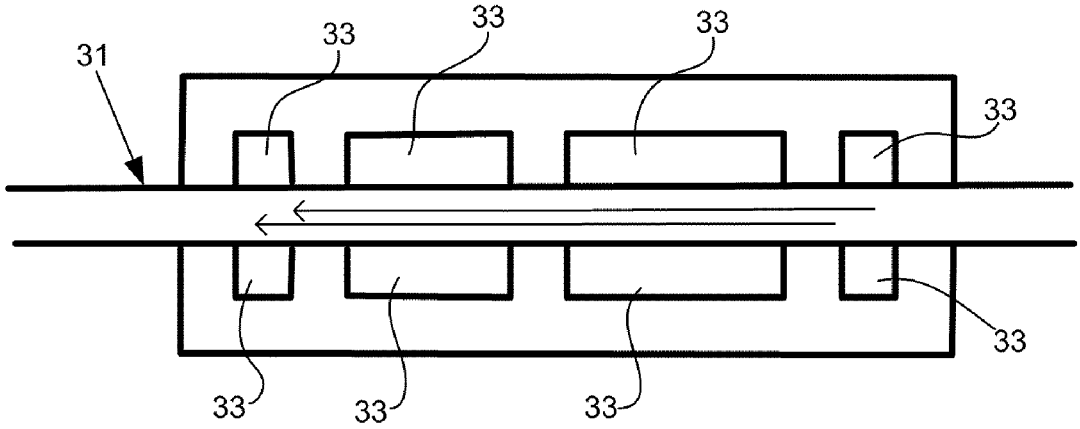

FIGS. 3A-B are illustrations of other approaches to varying the fluid's cross section and ensuing ion cross section. In FIG. 3A, the tube 31 is formed with varying cross sections with charge focusers 33 disposed at strategic locations along the tube 31 to provide an additional degree of focusing freedom. Additional descriptions are not provided as this figure is self-explanatory. FIG. 3B shows a series of charge focusers 33 that may be singly or aggregately controlled, thus providing an extended segment for cross sectional control. It should be noted that while the above FIGS. illustrate the charge focusers 33 as being "symmetric" about the tube 31, it is possible that a non-symmetric system for charge focusing may be utilized, as according to design preference.

Figure 4:
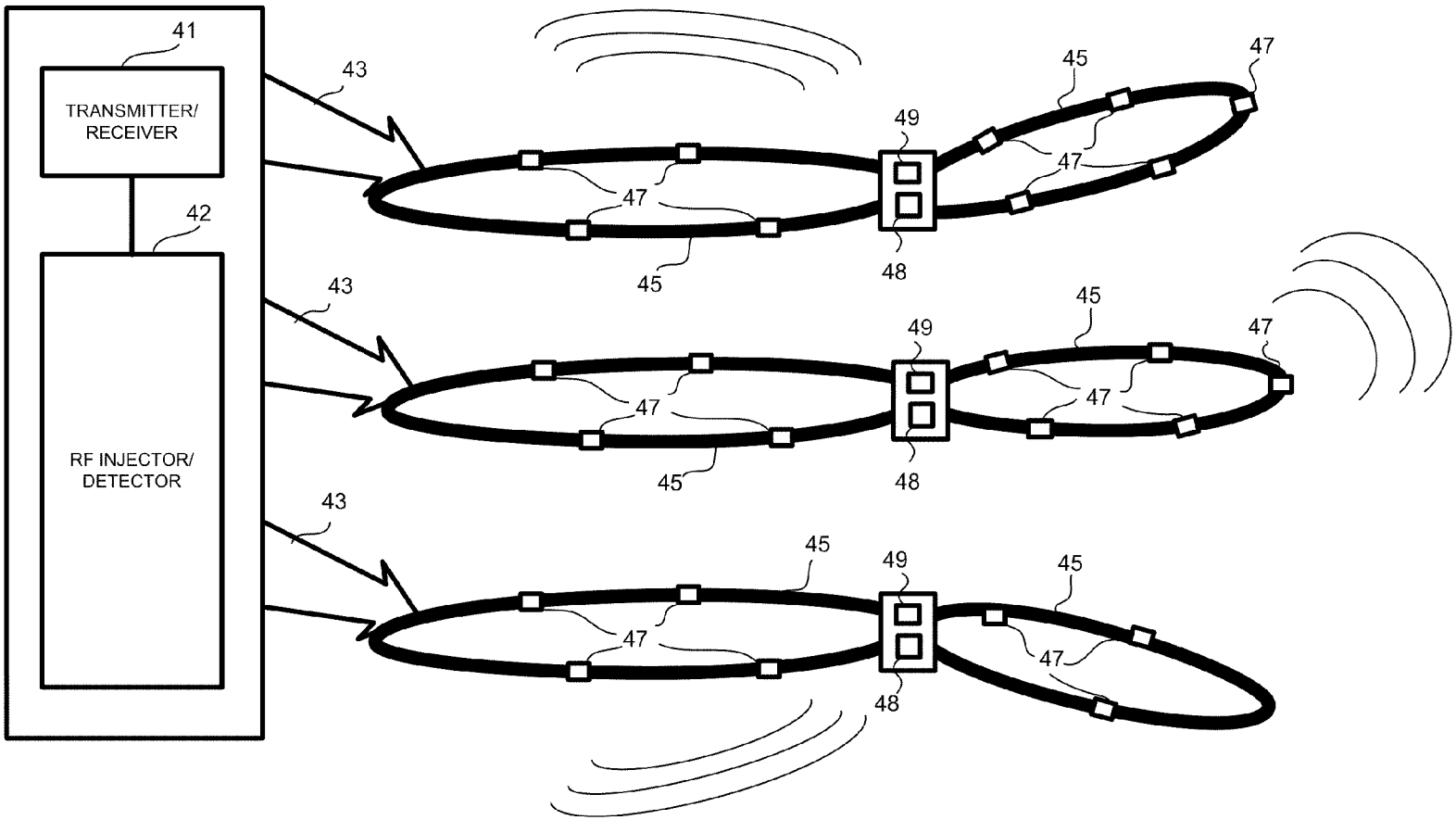
FIG. 4 is an illustration of an array of fluid antennas having controllable antenna lengths and orientations.

FIG. 4 is an illustration of an array of similarly configured fluid antennas having controllable antenna lengths and orientations. RF transmitter/receiver 41 is coupled to RF source 42 which provides excitation modes 43 into the tubes 45, with charge focusers 47 disposed at various points along the tubes 45. Opening and closing of various "sections" of the tubes 45 via valves 48 operates to change the orientation (as well as path length) of the fluid. Pump(s) 49 may be positioned near the valve 48, if so desired, for controlling the flow rate of the fluid. Positioning of the charge focusers 47 may vary according to the radiation pattern desired. Also, the charge focusers 47 may be staged in a particular order or sequence to arrive at the desired cross section, as well as provide an extended length of fluid having a common cross section. Thus, an increase in radiation can be obtained. In some embodiments, it may be desirable to position the charge focusers 47 at "bends" of the tubes 45 to exploit radiation effects from charges being accelerated around the bends. Or, in some embodiments the charge focusers 47 may be shared between tubes 45.

While FIG. 4 illustrates the fluid in the tubes 45 as being independent from each other, in some embodiments, it may be desirable to interconnect the tubes 45 to form a matrix of tubes 45, having controllable paths. Also, in some embodiments, each of the tubes 45 may be differently shaped or arranged. Further, a single "system" pump 49 may be used to drive the fluid(s) in the tubes 45.

One of ordinary skill in the art, having seen the above example, will understand that the above configuration can be modified to have symmetry, thus arriving at a full array of fluid antennas. With an array of antennas (either in 2D or 3D) phasing and directional control of the radiation pattern can be arrived at. Thus, the above exemplary embodiments of FIGS. 2, 3 and 4 can be used as building blocks for more sophisticated antenna systems.

While the term tube has been used to describe the physical "container" for the fluid(s), this term suggesting a hose-like container being flexible or rigid, or combinations thereof, it is expressly understood that this term may encompass any mechanism for containing a fluid. Thus, the container may be square, rectangular, inflatable, oblong, circular, or even open-ended. Also, in the embodiments described, the "tube" is understood to be of low permittivity. However, depending on design considerations, it may be possible to utilize a "tube" with an elevated permittivity that provides better matching of the fluid to the air impedance. These and other variations to the makeup of the tube/mechanism for containing the fluid are understood to be within the knowledge of one ordinary skill in the art, and may be implemented without departing from the spirit and scope of this disclosure.

Additionally, the precepts of this disclosure are tailored to the use of sea water as the exemplary charge (ion) carrying fluid. However, as one of ordinary skill is aware, other fluids may be used, including combinations of "charged" fluids and non-charged fluids, as well as gases that exhibit similar capabilities. For example, conductive fluids, silver/copper based fluids, brine solutions, a highly ionized fluid, and so forth may be placed in storage and utilized when desired. Also, based on the type of response desired, a low-ionized fluid/gas may be used, according to design preference. Along these lines, plasma may be utilized if containment can be obtained. Thus, combinations of fluids and gases may be used as the constituent medium. Based on the type of fluid used, the kind of focusing chargers or the method for focusing the charges may be altered, as well as the excitation method.

Accordingly, in view of the information provided in the above disclosure for the design and use of a simple fluidic antenna, it is envisioned that multiple variations including the use other mechanisms for RF excitation/detection as well as charge confinement systems, and so forth that are not described herein can be used that exploit the principles shown herein. For example, it is well known that the theory of reciprocity states that a radiating element can also operate as a receiving element. Therefore, while the above embodiments are described in the context of a transmitting system, it may also be used for receiving energy by appropriate modification of a transmitter to a receiver and the injection source to a receiving coupler.

What has been described above includes examples of one or more embodiments. It is, of course, not possible to describe every conceivable combination of components or methodologies for purposes of describing the aforementioned embodiments. It will, therefore, be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A fluidic antenna, comprising:

an electromagnetic energy coupler;

a non-metallic container coupled to the electromagnetic energy coupler;

fluid having charged particles moving through the non-metallic container at a predetermined rate; and a charge focuser disposed about the non-metallic container, wherein the electromagnetic energy coupler is configured to couple energy between the fluid and at least one of a transmitter and receiver, and the charge focuser is configured to adjust a cross sectional area of charged particles in the fluid to result in a fluid characteristic impedance that approaches that of a surrounding medium, thereby enabling at least one of launching and receiving electromagnetic energy.

2. The fluidic antenna of claim 1, wherein the non-metallic container forms a ring.

3. The fluidic antenna of claim 1, wherein the electromagnetic energy coupler utilizes magnetic flux linkage to couple into the fluid.

4. The fluidic antenna of claim 1, further comprising a pump that controls a rate of movement of the fluid in the non-metallic container.

5. The fluidic antenna of claim 1, further comprising a valve that controls at least one of a flow rate and direction of the fluid.

6. The fluidic antenna of claim 1, wherein the non-metallic container is collapsible.

7. The fluidic antenna of claim 1, wherein the non-metallic container is a tube.

8. The fluidic antenna of claim 1, wherein the non-metallic container is of a non-uniform cross section.

9. The fluidic antenna of claim 1, wherein the charge focuser utilizes a generated magnetic field to focus the charged particles in the fluid.

10. The fluid antenna of claim 1, wherein the fluid is sea water.

11. The fluidic antenna of claim 1, therein the fluid is gas.

12. The fluid antenna of claim 1, wherein the fluid is a combination of a liquid and a gas.

13. The fluidic antenna of claim 1, therein the charged particles are ions.

14. A fluidic antenna, comprising:

means for coupling energy;

means for holding charged particles in suspension, wherein the means for holding is moving at a predetermined rate of velocity;

means for conveying the means for holding; and means for focusing charges in the means for holding, wherein the means for coupling energy is capable of coupling energy between the means for holding and at least one of a transmitter and receiver, and the means for focusing is capable of adjusting a cross sectional area of charged particles in the means for holding to result in a characteristic impedance of the means for holding that approaches that of a surrounding medium, thereby enabling at least one of launching and receiving electromagnetic energy.

15. The fluidic antenna of claim 14, further comprising means for controlling a rate of velocity of the means for holding in the means for conveying.

16. The fluidic antenna of claim 14, further comprising means for controlling at least one of a flow rate and a direction of the means for holding.

17. A method for radiating or receiving electromagnetic energy using a liquid medium containing charged particles, comprising:

moving the liquid medium through a non-metallic container at a predetermined rate;

coupling an electrical signal into or from the charged particles resident in the moving liquid medium;

varying a cross section of the charged particles in the liquid medium; and adjusting at least one of a rate of velocity of the liquid medium and the cross section of the charged particles to result in a characteristic impedance of the liquid medium to approach that of a surrounding medium's characteristic, thereby enabling at least one of launching and receiving electromagnetic energy.

18. The method of claim 17, further comprising changing at a flow direction of the movement of the liquid medium into another non-metallic container.

19. The method of claim 17, wherein the rate of velocity of the liquid medium is facilitated via pumping.

20. The method of claim 17, further comprising changing a cross section of the non-metallic container.

* * * * *